US011846167B2

(12) United States Patent
Christinzio et al.

(10) Patent No.: US 11,846,167 B2
(45) Date of Patent: Dec. 19, 2023

(54) BLENDER TUB OVERFLOW CATCH

(71) Applicant: U.S. Well Services, LLC, Houston, TX (US)

(72) Inventors: Alexander Christinzio, Houston, TX (US); Jared Oehring, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 412 days.

(21) Appl. No.: 17/122,425

(22) Filed: Dec. 15, 2020

(65) Prior Publication Data

US 2021/0198993 A1 Jul. 1, 2021

Related U.S. Application Data

(60) Provisional application No. 62/955,316, filed on Dec. 30, 2019.

(51) Int. Cl.

| | |
|---|---|
| ***E21B 43/00*** | (2006.01) |
| ***E21B 43/26*** | (2006.01) |
| ***B01F 25/50*** | (2022.01) |
| ***B01F 33/502*** | (2022.01) |
| ***B01F 35/88*** | (2022.01) |
| ***B01F 35/21*** | (2022.01) |

(Continued)

(52) U.S. Cl.

CPC ..... *E21B 43/2607* (2020.05); *B01F 25/50* (2022.01); *B01F 33/5021* (2022.01); *B01F 35/2112* (2022.01); *B01F 35/71805* (2022.01); *B01F 35/883* (2022.01); *B01F 2101/49* (2022.01)

(58) Field of Classification Search

CPC ..... B01F 2101/49; B01F 35/883; B01F 33/5021; E21B 43/2607

See application file for complete search history.

(56) References Cited

U.S. PATENT DOCUMENTS

| | | | |
|---|---|---|---|
| 2,976,025 | A | 3/1961 | Pro |
| 3,878,884 | A | 4/1975 | Raleigh |
| 4,411,313 | A | 10/1983 | Johnson et al. |

(Continued)

FOREIGN PATENT DOCUMENTS

| | | | |
|---|---|---|---|
| CN | 104117308 | A | 10/2014 |
| CN | 104196613 | A | 12/2014 |

(Continued)

OTHER PUBLICATIONS

Kroposki et al., Making Microgrids Work, 6 IEEE Power and Energy Mag. 40, 41 (2008).

(Continued)

*Primary Examiner* — Anshu Bhatia

(74) *Attorney, Agent, or Firm* — Hogan Lovells US LLP

(57) ABSTRACT

In at least one embodiment, a system for a blender tub overflow catch is disclosed for fracturing operations using a fracturing fluid blender. In at least one embodiment, the system includes a first tub that may be a blender tub and a second tub forming a blender tub overflow catch that is adapted to circumvent an outside diameter of the first tub to catch overflow fluid from the first tub so that it can be directed back into the first tub upon a determination that the first tub has a capacity to handle the overflow fluid.

20 Claims, 4 Drawing Sheets

(51) Int. Cl.
*B01F 35/71* (2022.01)
*B01F 101/49* (2022.01)

(56) References Cited

U.S. PATENT DOCUMENTS 4,538,916 A 9/1985 Zimmerman
4,601,629 A 7/1986 Zimmerman
4,768,884 A 9/1988 Elkin
5,046,856 A * 9/1991 McIntire ..... B01F 25/421 366/291
5,114,239 A 5/1992 Allen
5,334,899 A 8/1994 Skybyk
5,439,066 A 8/1995 Gipson
5,486,047 A 1/1996 Zimmerman
5,580,168 A * 12/1996 Alireza ..... B01F 27/71 366/270
5,798,596 A 8/1998 Lordo
5,813,455 A 9/1998 Pratt et al.
5,950,726 A 9/1999 Roberts
6,035,265 A 3/2000 Dister et al.
6,097,310 A 8/2000 Harrell et al.
6,121,705 A 9/2000 Hoong
6,273,193 B1 8/2001 Hermann et al.
6,442,942 B1 9/2002 Kopko
6,585,455 B1 7/2003 Petersen et al.
6,788,022 B2 9/2004 Sopko
6,985,750 B1 1/2006 Vicknair et al.
7,795,830 B2 9/2010 Johnson
9,062,545 B2 6/2015 Roberts et al.
9,140,105 B2 9/2015 Pattillo
9,353,593 B1 5/2016 Lu et al.
9,506,333 B2 11/2016 Castillo et al.
9,790,858 B2 10/2017 Kanebako
9,945,365 B2 4/2018 Hernandez et al.
10,221,639 B2 3/2019 Romer et al.
10,408,030 B2 9/2019 Oehring et al.
10,408,031 B2 9/2019 Oehring et al.
10,415,332 B2 9/2019 Morris et al.
10,648,270 B2 5/2020 Brunty et al.
10,648,311 B2 5/2020 Oehring et al.
10,686,301 B2 6/2020 Oehring et al.
10,731,561 B2 8/2020 Oehring et al.
10,740,730 B2 8/2020 Altamirano et al.
10,767,561 B2 9/2020 Brady
10,781,752 B2 9/2020 Kikkawa et al.
10,794,165 B2 10/2020 Fischer et al.
10,988,998 B2 4/2021 Fischer et al.
2001/0000996 A1 5/2001 Grimland et al.
2004/0045703 A1 3/2004 Hooper et al.
2005/0201197 A1 9/2005 Duell et al.
2006/0109141 A1 5/2006 Huang
2008/0164023 A1 7/2008 Dykstra et al.
2008/0257449 A1 10/2008 Weinstein et al.
2008/0277120 A1 11/2008 Hickie
2009/0072645 A1 3/2009 Quere
2011/0081268 A1 4/2011 Ochoa et al.
2011/0110793 A1 5/2011 Leugemores et al.
2012/0063936 A1 3/2012 Baxter et al.
2012/0112757 A1 5/2012 Vrankovic et al.
2012/0150455 A1 6/2012 Franklin et al.
2013/0051971 A1 2/2013 Wyse et al.
2013/0284455 A1 10/2013 Kajaria et al.
2014/0174717 A1 6/2014 Broussard et al.
2015/0147194 A1 5/2015 Foote
2015/0233530 A1 8/2015 Sandidge
2016/0006311 A1 1/2016 Li
2016/0230660 A1 8/2016 Zeitoun et al.
2016/0326853 A1 11/2016 Fred et al.
2017/0082033 A1 3/2017 Wu et al.
2017/0096889 A1 4/2017 Blanckaert et al.
2017/0204852 A1 7/2017 Barnett
2017/0212535 A1 7/2017 Shelman et al.
2017/0370639 A1 12/2017 Barden et al.
2018/0090914 A1 3/2018 Johnson et al.
2018/0181830 A1 6/2018 Luharuka et al.
2018/0259080 A1 9/2018 Dale et al.
2018/0266217 A1 9/2018 Funkhauser et al.
2018/0284817 A1 10/2018 Cook et al.
2018/0298731 A1 10/2018 Bishop
2018/0312738 A1 11/2018 Rutsch et al.
2018/0313677 A1 11/2018 Warren et al.
2018/0363640 A1 12/2018 Kajita et al.
2018/0366950 A1 12/2018 Pedersen et al.
2019/0040727 A1 2/2019 Oehring et al.
2019/0128104 A1 5/2019 Graham et al.
2019/0145251 A1 5/2019 Johnson
2019/0154020 A1 5/2019 Glass
2019/0249527 A1 8/2019 Kraynek
2019/0257462 A1 8/2019 Rogers
2020/0040878 A1 2/2020 Morris
2020/0325760 A1 10/2020 Markham
2020/0350790 A1 11/2020 Luft et al.

FOREIGN PATENT DOCUMENTS

CN 112196508 A 1/2021
WO 2009046280 4/2009
WO 2014177346 11/2014
WO 2018044307 A1 3/2018
WO 2018213925 A1 11/2018
WO 2019210417 11/2019

OTHER PUBLICATIONS

Dan T. Ton & Merrill A. Smith, The U.S. Department of Energy's Microgrid Initiative, 25 The Electricity J. 84 (2012), pp. 84-94.
Non-Final Office Action issued in U.S. Appl. No. 16/871,328 dated Dec. 9, 2021.
Non-Final Office Action issued in U.S. Appl. No. 16/943,935 dated Oct. 21, 2021.
Non-Final Office Action issued in U.S. Appl. No. 16/564,186, dated Oct. 15, 2021.
Final Office Action issued in U.S. Appl. No. 16/356,263 dated Oct. 7, 2021.
Non-Final Office Action issued in U.S. Appl. No. 17/060,647 dated Sep. 20, 2021.
Non-Final Office Action issued in U.S. Appl. No. 16/901,774 dated Sep. 14, 2021.
Canadian Office Action issued in Canadian Application No. 3,094,768 dated Oct. 28, 2021.
International Search Report and Written Opinion mailed in PCT/US20/67526 dated May 6, 2021.
International Search Report and Written Opinion mailed in PCT/US20/67608 dated Mar. 30, 2021.
International Search Report and Written Opinion mailed in PCT/US20/67528 dated Mar. 19, 2021.
International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.
Non-Final Office Action issued in U.S. Appl. No. 16/871,928 dated Aug. 25, 2021.
Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Woodbury et al., "Electrical Design Considerations for Drilling Rigs," IEEE Transactions on Industry Applications, vol. 1A-12, No. 4, Jul./Aug. 1976, pp. 421-431.
Morris et al., U.S. Appl. No. 62/526,869, Hydration-Blender Transport and Electric Power Distribution for Fracturing Operation; Jun. 28, 2018; USPTO; see entire document.
Final Office Action dated Feb. 4, 2021 in U.S. Appl. No. 16/597,014.

(56) References Cited

OTHER PUBLICATIONS

International Search Report and Written Opinion dated Feb. 4, 2021 in PCT/US20/59834.
International Search Report and Written Opinion dated Feb. 2, 2021 in PCT/US20/58906.
International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.

* cited by examiner

BLENDER TUB OVERFLOW CATCH

CROSS-REFERENCE TO RELATED APPLICATION

The present application is related to and claims benefit of priority to U.S. Provisional Application No. 62/955,316, titled BLENDER TUB OVERCATCH FLOW, filed on Dec. 30, 2019, the entire disclosure of which is incorporated by reference herein for all intents and purposes.

BACKGROUND

Field of Invention

At least one embodiment relates to fracturing operations. In at least one embodiment, a blender tub overflow catch for a fracturing operation is disclosed.

Related Technology

Fracturing, such as hydraulic fracturing, stimulates production from hydrocarbon producing wells. Such a process may utilize mobile systems for injection fluid into wellbores at pressures that are determined to provide subterranean fissures in areas around wellbores. A fracturing process may also rely on a fracturing fluid slurry that has been pressurized using high pressure pumps. As a fracturing process may include mobility requirements, high pressure pumps are required to be mounted on mobile surfaces of a fracturing fleet—such as, on skids, on truck-beds, and on trailers. Moreover, high pressure pumps may be powered by mobile power sources, such as by diesel engines. However, fracturing equipment components, such as the high-pressure pumps and associated power sources are required to have large volumes and masses to support hydraulic fracturing pumps that draw low pressure fluid slurry at approximately 100 pounds per square inch (psi). The discharge of the same fluid slurry may be required to be at high pressures of up to 15,000 psi or more. A single tub associated with fluid slurry may be mounted on a trailer, skid, or body load.

A fracturing fluid blender may be provided in a fracturing fleet for blending components of a hydraulic fracturing fluid. Blended components are supplied to the high-pressure pumps. Blending components that are fluid or liquid, such as chemicals, water, and acid may be supplied via fluid lines from respective sources. Blending components that are solid, such as mud or sand are supplied via a conveyor belt or augers. While the fracturing fluid blender may be provider in a mobile unit, the blending itself occurs in a blending tub of the fracturing fluid blender. When the tub overflows during a blending operation, fluid that may or may not have containment can run down the sides of the tub and onto the ground.

SUMMARY

In at least one embodiment, an improvement to address the above-described issues is described. In at least one embodiment, a system having a first tub and a second tub to be associated with a fracturing fluid blender addresses the above-described issues. In at least one embodiment, a second tub is adapted to circumvent an outside diameter of a first tub and is adapted with a height that is determined based in part on at least one overflow constraint of an application of the fracturing fluid blender. In at least one embodiment, one or more valves and routing pipes associated with a second tub directs an overflow fluid received in the second tub, from a first tub, to be returned to the first tub upon a determination that the first tub has a capacity to handle the overflow fluid.

In at least one embodiment, a method is disclosed to address the above-described issues. In at least one embodiment, such a method includes associating a first tub and a second tub with a fracturing fluid blender. In at least one embodiment, a sub-process of such a method includes enabling a second tub to circumvent an outside diameter of the first tub and to comprise a height that is a determined based in part on at least one overflow constraint of an application of a fracturing fluid blender. In at least one embodiment, such a method includes associating one or more valves and routing pipes with a second tub to direct an overflow fluid received in a second tub, from a first tub, to be returned to a first tub upon a determination that the first tub has a capacity to handle the overflow fluid.

BRIEF DESCRIPTION OF THE DRAWINGS

Various embodiments in accordance with the present disclosure will be described with reference to the drawings, in which.

DETAILED DESCRIPTION

Figure 1:
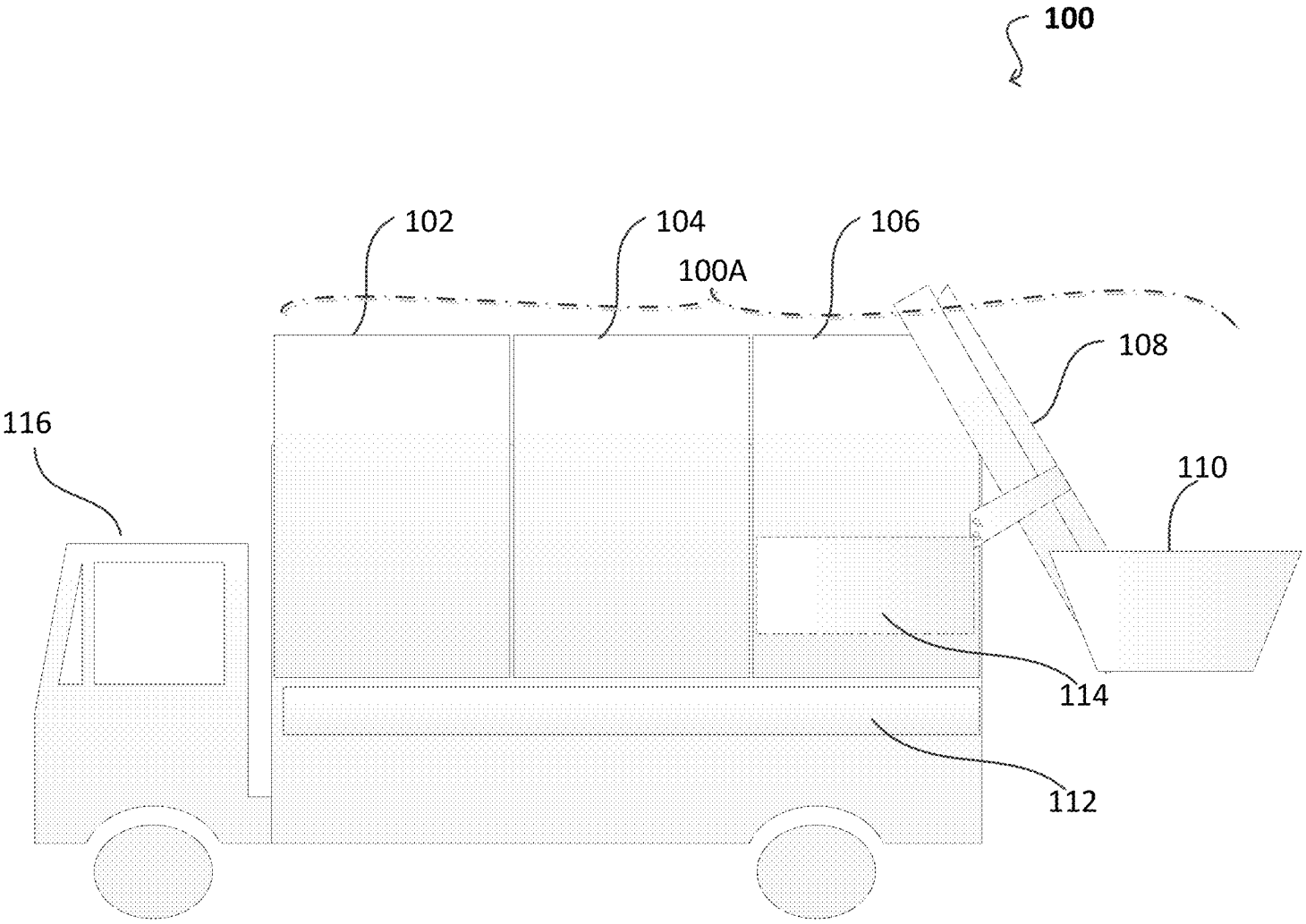
FIG. 1 illustrates an example system of a fracturing fluid blender subject to improvements of the present disclosure in accordance with at least one embodiment.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In at least one embodiment, a system and a method herein addresses complexities and deficiencies in the blender tub of a fracturing fluid blender by providing a catch ring adapted to fit around a blender tub and adapted to serve as a place for overflow to collect and be captured without releasing into a ground around an area of the fracturing fluid blender or without contaminating the ground around the area.

In at least one embodiment, such a system includes a first tub (or a primary tub) that may be the blender tub and a second tub (or a secondary tub) that is adapted to circumvent an outside diameter of the first tub. In at least one embodiment, the first tub has a first height. In at least one embodiment, the second tub has a second height that is a predetermined height, including at least an equal height to or a lesser height than the first height of the first tub.

In at least one embodiment, a predetermined height for a second tub may be calculated according to overflow constraints or requirements of an application of the fracturing fluid blender. In at least one embodiment, an overflow constraint or requirement represents or includes an amount of the overflow fluid expected from a determined mix of blending components in a fracturing blending application or operation. In at least one embodiment, one or more valves may be provided in the second tub, along with routing pipes, to direct an overflow fluid that is or that includes the blender fluid from the first tub back into the first tub, through the second tub, once a determination is made that the first tub has a capacity to handle the overflow fluid. In at least one embodiment, a determination of capacity may be by an indication of the capacity as sensed from a sensor, either of blender fluid in the first tub or that a first amount of the blender fluid has been evacuated from the first tub. In at least one embodiment, a determination can include that a second amount of overflow fluid, equal to or less than the first amount, may be returned to the first tub.

In at least one embodiment, an indication of fluid level may be made after a sensed input from one or more sensors, of a first tub level, as well as a sensed input from one or more sensors of a second tub level. In at least one embodiment, one or more sensors include a flow sensor, radar, sonar, or any appropriate sensing device capable of providing one or more of at least the above-referenced indications.

In at least one embodiment, at least one sensor may enable a system to determine a capacity change of a first tub based in part blender fluid discharged from the first tub for a fracturing application. In at least one embodiment, at least one sensor may be adapted to provide input to a system to enable an overflow fluid to be returned to a first tub.

In at least one embodiment, one or more valves may include actuation valves, hydraulic valves, electric valves, air valves, or manually-operated valves. In at least one embodiment, a second tub may be used as storage for an overflow fluid for at least a predetermined amount of time. In at least one embodiment, overflow fluid stored in a second tub may be irrespective of a level of blender fluid in a first tub. In at least one embodiment, a flow meter may be provided in routing pipes associated with one or more valves to collect a quantity of overflow fluid that is caught in the second tub. In at least one embodiment, a flow meter may be used to determine an amount of overflow fluid that is otherwise prevented from being released uncontrollably from a first tub. In at least one embodiment, such a determination may be based in part on current flow monitored from a first tub along with height of blending fluid in the first tub, which can represent a static head pressure of the blending fluid.

In at least one embodiment, addition of an overflow catch, also referred to herein as a catch ring, to a blender tub prevents overflow from spillage to a ground or any surface underlying a fracturing fluid blender of a fracturing fleet. In at least one embodiment, a catch pan may be used as an overflow catch, by being positioned around an outer perimeter of a blender tub so that any overflow fluid of a blender fluid in the blender tub would be caught and contained rather than running off a trailer and being release into the ground.

In at least one embodiment, a catch pan may be coupled back into a suction side of a fracturing fluid blender, via an actuating valve and a blender tube (referred to as routing pipes), in order to empty an overflow fluid back into a blender tub once an indication is sensed or determined that a blender fluid level in a blender tub has receded. In an aspect, such a process enables adaptation of an existing component of a fracturing fluid blender by only a slight modification, in at least blending components being recycled without wastage.

FIG. 1 illustrates an example system 100 of a fracturing fluid blender 100A subject to improvements of the present disclosure in accordance with at least one embodiment. A system 100 herein may be a fracturing fluid blender 100A on a mobile unit 116 that is part of a fracturing fleet. In at least one embodiment, a fracturing fluid blender 100A may include a mechanical unit 102, a control unit 104, and a blending unit 106. In at least one embodiment, a blending unit 106 may be supported by augers or other transporting mechanisms 108 and by a blender tub 114, as well as proppant hopper 110. In at least one embodiment, a blender tub 114 is referenced as a first tub herein that is supported by a second tub that forms an overflow catch.

In at least one embodiment, fluid and solid control unit 112 may include valves and tank components to buffer or provide a solid or fluid components for blending in the blender tub 114. In at least one embodiment, a mechanical unit 102 may include high- and low-pressure pumps. In at least one embodiment, one or more of provided pumps, of valves, or of tank components may be external to a fracturing fluid blender. In at least one embodiment, sand may be transferred from an external holding area or tank to a blender tub 114 directly or using augers or other transporting mechanisms 108. In at least one embodiment, a proppant hopper 110 may be used as a tank or may be used as an intermediate storage from an external holding area.

In at least one embodiment, other transporting mechanisms 108 than augers may be conveyer belts and drop-tanks. In at least one embodiment, while FIG. 1 illustrates sections 102-106 as rectangular modules, a person of ordinary skill reading the present disclosure will readily understand that specific components for a mechanical unit can include pumps, motors, and drive trains; for a control unit, can include sensors, screens, and man-machine interfaces; and for a blending unit, can include valves, directors, and protectors, which may be used in at least one application with a blender tub overflow catch.

Figure 2:
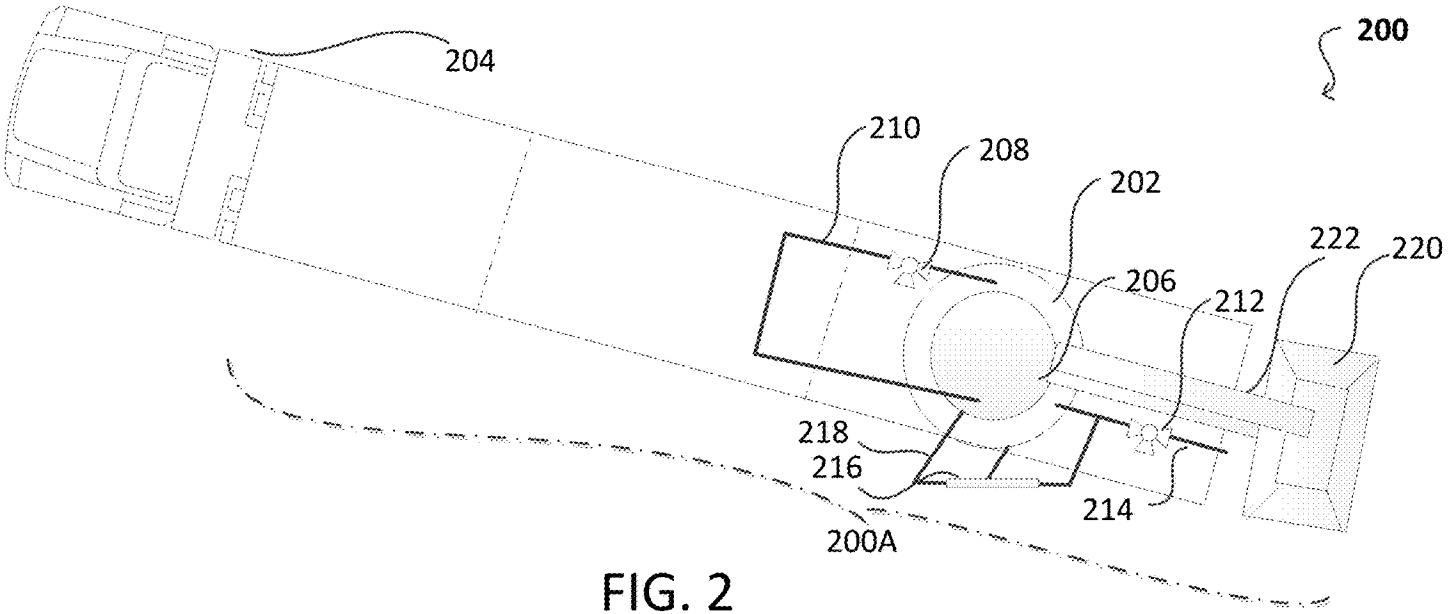
FIG. 2 illustrates a top view of a blender tub overflow catch on a fracturing fluid blender of a mobile unit in accordance with at least one embodiment.

FIG. 2 illustrates a top view of a blender tub overflow catch 202 on a fracturing fluid blender 200A as part of a system 200, in accordance with at least one embodiment of the present disclosure. FIG. 2 illustrates a mobile unit 204 which may be like mobile unit 116, but with improvements to at least a blending unit. In at least one embodiment, aspects of sections 102-106 from FIG. 1 may be available in an implementation in FIG. 2 and are by incorporated expressly with respect to the discussion in FIG. 2 and with an addition of features 208-218 illustrated with respect to an overflow catch 202.

In at least one embodiment, a fracturing fluid blender 200A includes a first tub 206 that may be a blender tub and includes a second tub 202 that is adapted to circumvent an outside diameter of a first tub 206. In at least one embodiment, a second tub 202 may have a second height that is a predetermined height. In at least one embodiment, a predetermined height may include at least an equal height to or a lesser height than a first height of a first tub 206. In at least one embodiment, a predetermined height may be calculated according to overflow constraints or requirements of an application of the fracturing fluid blender 200A. In at least one embodiment, an overflow constraint includes an amount of the overflow fluid expected from a determined mix of blending components. In at least one embodiment, certain mixes of blending components, such as having more fluid components may overflow faster than others having other aggregate or solid components. In at least one embodiment, one or more valves 208 may be provided with association to a second tub 202, along with routing pipes 210, to direct an overflow fluid that may include a blender fluid from the first tub 206 back into the first tub 206 through a second tub 202, once a determination is made that the first tub 206 has a capacity to handle the overflow fluid.

In at least one embodiment, a blender fluid may be generally used herein to refer to one or more of: individual components in a process of being blended, individual components as provided in component form, or individual components after it has been fully blended together. As such, by being within a blender tub, and for being subject to a blending operation, any material therein is therefore a blender fluid. In at least one embodiment, physically, a blender fluid may be one or more of solid components, fluid or liquid components, or a combination thereof. In at least one embodiment, solid components for a first tub 206 may be provided from a proppant hopper 220 using transportation mechanism 222, while fluid or liquid components may be provided as discussed with respect to FIG. 3.

In at least one embodiment, an indication of a capacity available in a first tub 206 may be sensed using sensor 216 that may sense that a first amount of blender fluid has been evacuated from a first tub 206. In at least one embodiment, blender fluid may be evacuated via delivery pipe 214 using valve 212. In at least one embodiment, blender fluid may be evacuated for application in a fracturing operation. In at least one embodiment, alternatively, a sensor 216 may sense that blender fluid is being evacuated at a predetermined rate through a valve 212 or through a routing pipe 214, and a system associated with a sensor may make a determination of a capacity in a first tub 206 available to receive more components for blending or to receive at least a portion of an overflow fluid from a second tub 202.

In at least one embodiment, a second amount of an overflow fluid, equal to or less than the first amount, may be returned to the first tub 206 from the second tub 202 via routing pipes 210. In at least one embodiment, therefore, at least one sensor enables a system to determine a capacity available in a first tub based in part on an evacuation of a first amount of blender fluid from within the first tub, and the at least one sensor provides input to the system to enable a second amount of the overflow fluid that is less than or equal to the first amount to be returned to the first tub.

In at least one embodiment, an indication may be based in part on a determination, using input one or more sensors 216, of a first tub level (corresponding to blending fluid level), and may also be based in part on an indication may be also based in part on sensed information from one or more sensors 216 of a second tub level (corresponding to overflow fluid level). In at least one embodiment, one or more sensors 216 include a flow sensor, radar, sonar, or any appropriate sensing device capable of providing one or more of at least the above-referenced indications. In at least one embodiment, one or more valves 208, 212 may include actuation valves, hydraulic valves, electric valves, air valves, or manually-operated valves.

In at least one embodiment, a second tub 202 may be used as storage for overflow fluid for at least a predetermined amount of time. In at least one embodiment, such a use maybe irrespective of a level of blender fluid in a first tub 206. In at least one embodiment, a flow meter of the one or more sensors 216 may be provided to operate with or without input from routing pipes 210 provided to collect a quantity of overflow fluid that is caught in a second tub 202. In at least one embodiment, one or more sensors 216 may be used to sense a rise in height of overflow fluid in a second tub 202 to determine a flow rate from a first tub 206.

In at least one embodiment, a flow meter may alternatively be connected to an overflow pipe to direct overflow fluid from a first tub 206 to a second tub 202, and would be able to more precisely determine an amount of overflow fluid that is otherwise prevented from being released uncontrollably from the first tub. In at least one embodiment, pipes 218, as illustrated, are provided to be used with one or more sensors 216. In at least one embodiment, one or more sensors 216 for sensing fluid levels, as discussed, such as low blending fluid level, may inform a system to cause overflow fluid to be directed from the first tub 206 to the second tub 202. In at least one embodiment, such a process enables recycling of blending components when unexpected overflow occurs for at least environmental safety and for efficiency purposes.

Figure 3:
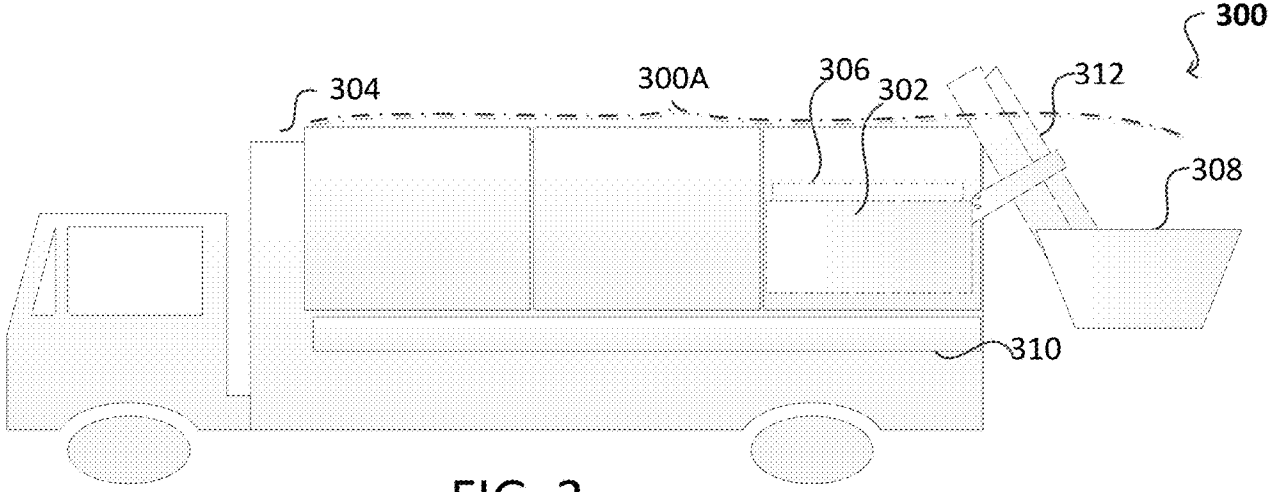
FIG. 3 illustrates a side view of a blender tub overflow catch on a fracturing fluid blender of a mobile unit in accordance with at least one embodiment.

In at least one embodiment, FIG. 3 illustrates a side view of a blender tub overflow catch 302 on a fracturing fluid blender 300A as part of a system 300 hosted on a mobile unit 304. In at least one embodiment, aspects from FIG. 2, including the one or more valves 208, 212, the one or more sensors 216, the pipes 210, 214, 218, may be available in FIG. 3, as a person of ordinary skill reading the present disclosure and figures would readily understand that FIG. 3 may be a side view of a mobile unit illustrated in FIG. 2. As such, the aspects from FIG. 2 applied in FIG. 3 perform functions in FIG. 3 as they were discussed with respect to FIG. 2.

In at least one embodiment, in FIG. 3, while a blender tub overflow catch 302 is illustrated as shorter in height than the first tub 306, this is merely exemplary. Other dimensional changes may be readily made by a person of ordinary skill reading the present disclosure and based in part on an application of a fracturing fluid blender 300A, in at least one embodiment. Fluid or liquid components for a blender tub 306 may be provided from a fluid and solid control unit 310 that may include valves and tank components to buffer or provide fluid components for blending in a blender tub 306. In at least one embodiment, solid control in a fluid and solid control unit 310 may be a mechanical control for a transportation mechanism 312 to transport solid components from a proppant hopper 308 to a blender tub 306.

Figure 4:
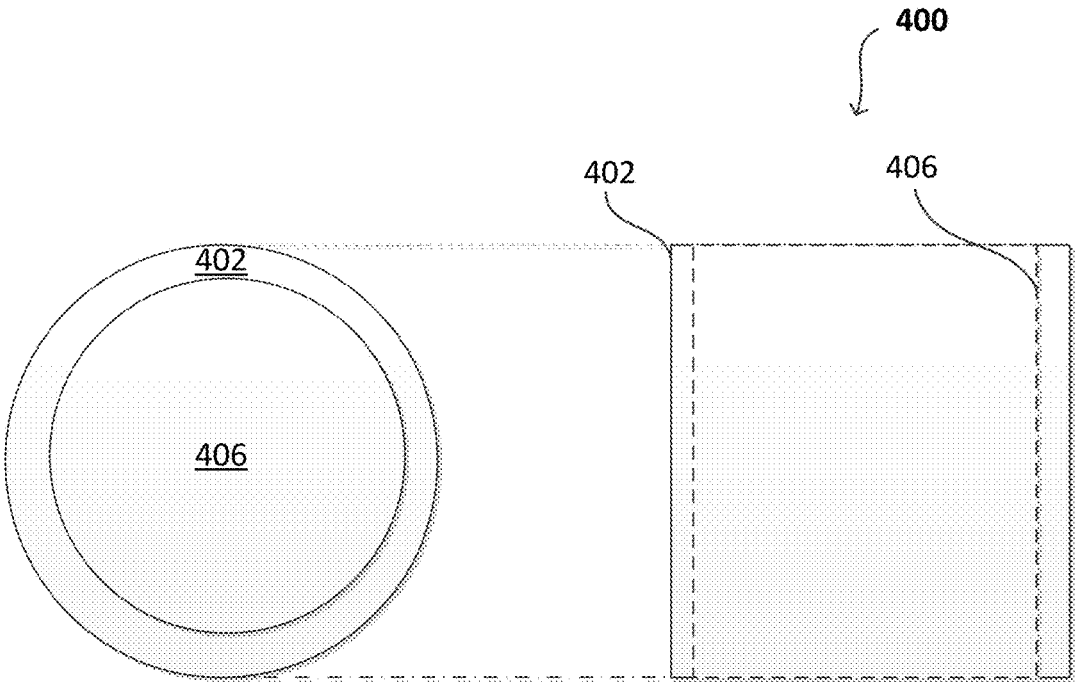
FIG. 4 illustrates a top view and a side view of a blender tub overflow catch in accordance with at least one embodiment.

In at least one embodiment, FIG. 4 illustrates a top view and a side view of a blender tub overflow catch 402. As discussed with respect to FIGS. 2 and 3, a blender tub overflow catch or second tub 402 circumvents, on at least one side, and may encompass, at a bottom portion, a primary or first tub 406. In at least one embodiment, this is so that any overflow fluid from a primary tub 406 may be collected and retained in a blender tub overflow catch 402. In at least one embodiment, a blender tub overflow catch 402 therefore prevent spills, to an underlying surface, of blender fluid overflowing (referred to, once overflowing, as overflow fluid) a primary or first tub 406.

In at least one embodiment, prevention of spill is with regard to overflow fluid that is prevented from contacting a ground level under a mobile unit. In at least one embodiment, pipes discussed regarding FIGS. 2 and 3, and particularly routing pipes, may be provided as plumbing for enabling an overflow fluid to be suctioned, as a self-sufficient process, between a primary tub 406 and an overflow catch 402. In at least one embodiment, a self-sufficient process is automated by sensors sensing an overflow fluid and enabling a suction of a overflow fluid back into a primary tub 406, or is automated by a suction within an overflow pipe, such as pipe 218 of FIG. 2 that enables capillary or other suction mechanism to continuously transfer an overflow fluid back to a primary tub 406. In this manner, in at least one embodiment, a system ensures that a blender tub overflow catch 402 is always at a low or an empty level at a start of any new operation. In at least one embodiment, instead of provided piping 218 to return overflow fluid, an overflow fluid remains in a blender tub overflow catch 402 till it is evacuated to a holding tank using a vacuum truck or other vacuum system.

In at least one embodiment, a control unit 104, when applied with improvements for the blender tub overflow catch 202, 302; 402 of FIGS. 2-4, enables a self-sufficient process by self-emptying of a system including the blender tub overflow catch 402. In at least one embodiment, sensors 216 and a logic discussed throughout, such as a system adapted to determine flow rate and at least a level of blender fluid in a blender tub, makes it is possible to achieve a self-sufficient process. In at least one embodiment, such logic may include system features adapted for determining that a blender tub level in less than a first predetermined percentage, for determining that an overflow level of an overflow fluid in a blender tub overflow catch 402 is above a second predetermined percentage, and for opening a valve (such as a provided valve 208) to allow a suction pump to suction blending fluid from a blender tub overflow catch 402 so that it may be pumped into a blender tub.

In at least one embodiment, alternatively, an empty catch pan button may be made available that may be used to cause evacuation of a blender tub overflow catch 402 by a suction pump at a click of a button in view of one or more of such above-referenced logic being satisfied. Further, in at least one embodiment, it is possible to have a blender tub overflow catch 402 empty itself back into a blender tub or to a discharge manifold by at least capillary action, as discussed with reference to FIGS. 2, 3. In at least one embodiment, at least one sensor enables a system to determine a capacity change of a first tub based in part blender fluid discharged from the first tub for a fracturing application, and the at least one sensor provides input to the system to enable the overflow fluid to be returned to the first tub. In at least one embodiment, at least one sensor enables a system to determine a capacity change of a first tub based in part on a level of blender fluid within the first tub, and the at least one sensor provides input to the system to enable the overflow fluid to be returned to the first tub.

Figure 5:
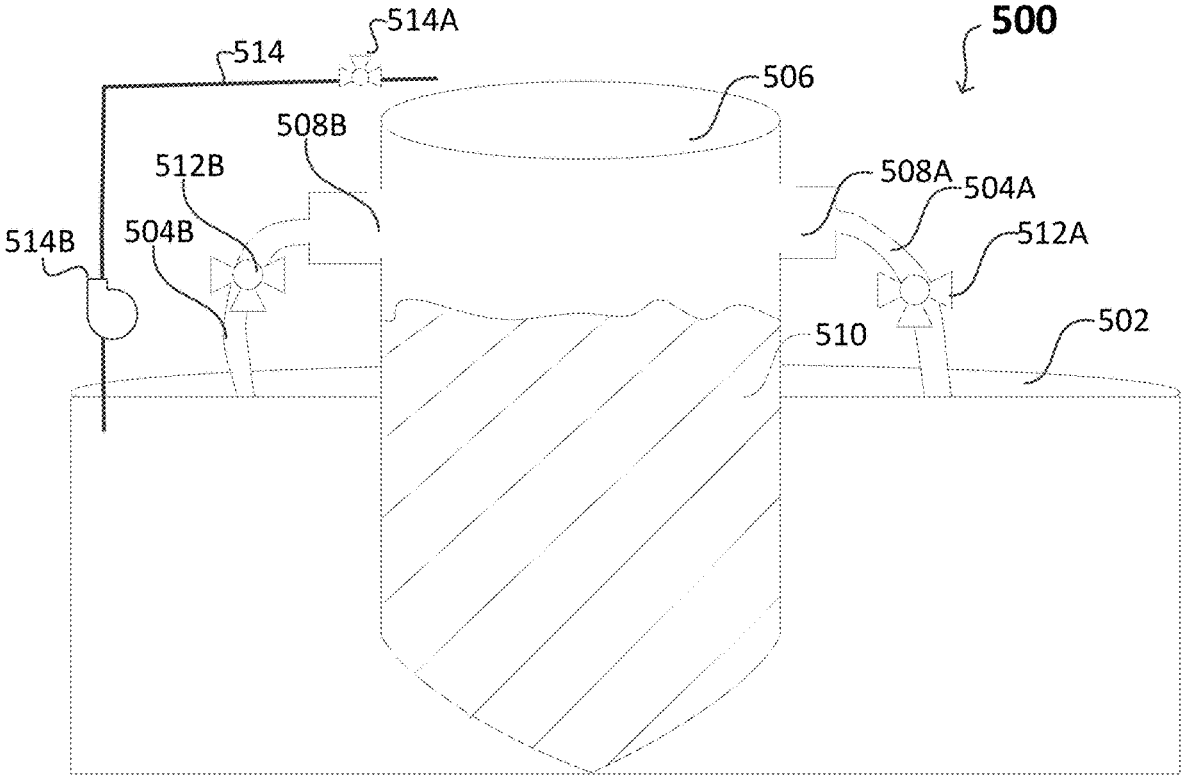
FIG. 5 illustrates a perspective view of a blender tub overflow catch distinctly located from the blender tub in a system that is in accordance with at least one embodiment.

FIG. 5 illustrates a perspective view of a blender tub overflow catch 502 distinctly located from a blender tub 506 in a system 500 that is in accordance with at least one embodiment. In at least one embodiment, a system 500 includes a blender tub overflow catch 502 located offset or in a different area than a blender tub 506, and not around a blender tub 506. In at least one embodiment, blender fluid 510 that may rise to a level that is considered excess for a blender tub 506; and may then be routed through one or more (such as circumventing or in singular locations) overflow ports 508A, B and through one or more channels 504A, B to a blender tub overflow catch 502.

In at least one embodiment, a blender tub overflow catch 502 is a collective reference to multiple distinct tubs to catch an overflow of blender fluid 510 from multiple distinct ports 508A, B. In an aspect, a blender tub 506 has a wall that extends higher than a predetermined height for a traditional blender tub. In at least one embodiment, a blender tub 506 is provided with overflow ports 508A, B on one or more sides, or circumventing a blender tub 506, with structural support being provided between a first height of a blender tub 506 and an extended height provided for a blender tub 506. In at least one embodiment, overflow ports 508A, B act as drain points when blender fluid 510 reaches a level of over lowest part of a height of these ports (with respect to a bottom of a blender tub 506). In an aspect, plumbing, including valves 512A, B, may be provided to activate an overflow drain or port to cause overflow into a blender tub overflow catch 502 or to an intermediate reservoir (prior to draining to the blender tub overflow catch 502). In at least one embodiment, an intermediate reservoir may include a tote, a fracturing tank, or other vessel having features or properties of a tote or a fracturing tank.

In at least one embodiment, as in example system 200 of FIG. 2, automation aspects, such as sensors, may be used with a system 500 in FIG. 5 so that a first amount of the blender fluid may be sensed as having been evacuated from a first tub 506. In at least one embodiment, blender fluid may be evacuated via ports 508A, B using valves 512A, B. In at least one embodiment, alternatively, a sensor may sense that blender fluid is being evacuated at a predetermined flow rate through one or more valves 512A, B or through the channel 504A, B, and may make a determination of a capacity remaining in a first tub 506 that is available to receive more components for blending or at least a portion of overflow fluid from a second tub 502. A second amount of overflow fluid, equal to or less than the first amount, may be returned to a first tub 506 from a second tub 502 via routing pipes 514 and at least one valve 514A. In at least one embodiment, a pump 514B may be used for returning overflow fluid to a first tub 506. In at least one embodiment, other aspects discussed with respect to FIG. 2 may be readily adapted for a system 500 in FIG. 5, by a person of ordinary skill reading the present disclosure.

Figure 6:
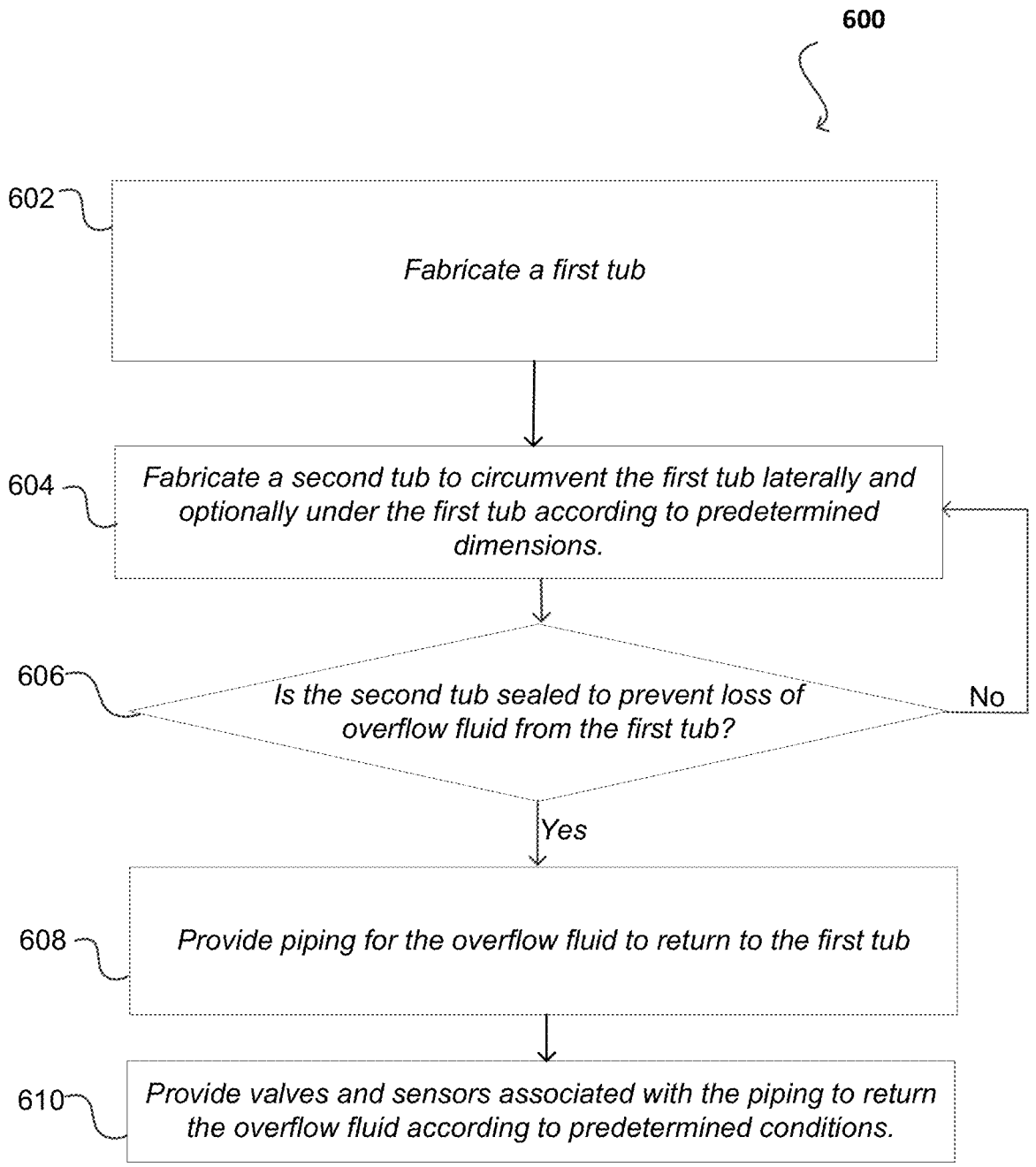
FIG. 6 illustrates a method for manufacture and/or use of a blender tub overflow catch in accordance with at least one embodiment.

FIG. 6 illustrates a method 600 for manufacture and/or for use of a blender tub overflow catch in accordance with at least one embodiment. In at least one embodiment, fabrication of a blender tub may include fabrication of a blender tub overflow catch that is adapted to circumvent an outside of the blender tub. In at least one embodiment, a blender tub overflow catch may be fabricated to circumvent a blender tub and may be fabricated with a same or similar height of the blender tub. In at least one embodiment, alternatively, a blender tub overflow catch may be shortened in height depending on its application or other parameters of an application of a fracturing fleet.

In at least one embodiment, an overall height of a blender tub overflow catch (or separately, of a blender tub) may be based in part on a capacity of overflow fluid intended to be stored or passed in a blender tub overflow catch. In at least one embodiment, a blender tub itself may be adapted to requirements of a system in which it is used. In at least one embodiment, a blender tub overflow catch may serve as storage or holding place for overflow fluid. In at least one embodiment, a blender tub overflow catch may include a cover and safety features to retain overflow fluid for a period while a mobile unit hosting a blender tub is stationary or in motion. In at least one embodiment, at least one sensor enables a system to determine a capacity change of the first tub based in part on an evacuation of blender fluid from within the first tub to a storage container, and the at least one sensor provides input to the system to enable the overflow fluid to be returned to the first tub. In at least one embodiment, one or more valves in provided routing pipes, as discussed with respect to FIGS. 2, 3, may use any appropriate method for actuation, including, in a non-limiting manner, hydraulic, electric, air, or manual actuation. In at least one embodiment, one or more sensors for detecting a blender tub level or the blender tub overflow catch level may be one or more of available types of sensors, including flow sensors, radar, sonar, or any other appropriate sensing device to provide or be able to infer level of overflow fluid or of blender fluid.

In at least one embodiment, a first sub-process 602 is for fabricating a first tub in method 600. In at least one embodiment, alternatively, a method 600 may be applied to an existing blender tub. In at least one embodiment, sub-process 604 may be started if an existing blender tub is provided for a remainder of method 600. In at least one embodiment, a sub-process 604 is for fabricating a second tub, forming the blender tub overflow catch, to circumvent a first tub laterally, and may optionally be fabricated to be under the first tub.

In at least one embodiment, a fabrication feature in sub-process 604, for a second tub, may be according to predetermined dimensions based in part on dimensions of a first tub and depending on application requirements for a fracturing fluid blender having the tubs. In at least one embodiment, sub-process 602 and at least a part of sub-process 604 may represent a feature for associating a first tub and a second tub with a fracturing fluid blender. In at least one embodiment, sub-process 604 partly includes a feature for enabling a second tub to circumvent an outside diameter of a first tub and to comprise a height that is a determined based in part on at least one overflow constraint of an application of the fracturing fluid blender. In at least one embodiment, aspects of dimensions and height required for at least a second tub require consideration to dimensions of a first tub and requirements of a fracturing fluid blender application.

Sub-process 606 performs verification that a second tub is sealed so that no overflow fluid from a first tub may leak out of a second tube. In at least one embodiment, with a verification confirmed that proper seals exist for a second tub, piping may be provided to return overflow fluid to a first tub. Otherwise, if a verification of a second seal indicates a failure, sub-process 604 may be repeated. Sub-process 610 provides valves and sensors associated with piping so that overflow fluid may be returned according to predetermined conditions of one or more of a first tub, a second tub, or an overflow fluid.

At least one embodiment can be implemented in a wide variety of operating environments. In at least one embodiment, a control unit for a blender tub overflow catch system can include one or more user computers, computing devices, or processing devices which can be used to operate in any of a number of applications. User or client devices can include any of a number of personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

At least one embodiment can be implemented as part of at least one service or Web service, such as may be part of a service-oriented architecture for external communication of the results, for example. Services such as Web services can communicate using any appropriate type of messaging, such as by using messages in extensible markup language (XML) format and exchanged using an appropriate protocol such as SOAP (derived from the "Simple Object Access Protocol"). Processes provided or executed by such services can be written in any appropriate language, such as the Web Services Description Language (WSDL). Using a language such as WSDL allows for functionality such as the automated generation of client-side code in various SOAP frameworks.

Some embodiments utilize at least one network that would be familiar to those skilled in the art for supporting communications using any of a variety of commercially-available protocols, such as TCP/IP, OSI, FTP, UPnP, NFS, CIFS, and AppleTalk. The network can be, for example, a local area network, a wide-area network, a virtual private network, the Internet, an intranet, an extranet, a public switched telephone network, an infrared network, a wireless network, and any combination thereof.

A client environment may be developed in the mobile unit to include a variety of databases and other memory and storage media as discussed above. These can alternatively reside in a variety of locations, such as on a storage medium local to (and/or resident in) one or more of the computers or remote from any or all of the computers across the network. In at least one embodiment, information from the present system may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

In at least one embodiment, such devices referenced throughout herein also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments. Additionally, if a particular decision or action is described as being made or performed "based on" a condition or piece of information, this should not be interpreted as that decision or action being made or performed exclusively based on that condition or piece of information, unless explicitly so stated.

The specification and drawings are, accordingly, to be regarded in an illustrative rather than a restrictive sense. It will, however, be evident that various modifications and changes may be made thereunto without departing from the broader spirit and scope of the invention as set described herein.

What is claimed is:

1. A system comprising:

a first tub and a second tub to be associated with a fracturing fluid blender, the second tub adapted to circumvent an outside diameter of the first tub and adapted with a height that is determined based in part on at least one overflow constraint of an application of the fracturing fluid blender;

a processing unit and tank components configured to buffer or provide blending components for the first tub based in part on the at least one overflow constraint; and one or more valves and routing pipes associated with the processing unit and the tank components to direct an overflow fluid received in the second tub, from the first tub, to be returned to the first tub upon a determination that the first tub has a capacity to handle the overflow fluid.

2. The system of claim 1, wherein the at least one overflow constraint comprises an amount of the overflow fluid expected from a determined mix of the blending components.

3. The system of claim 1, further comprising:

at least one sensor to enable the system to determine a capacity change of the first tub based in part blender fluid discharged from the first tub for a fracturing application, the at least one sensor to provide input to the system to enable the overflow fluid to be returned to the first tub.

4. The system of claim 1, further comprising:

at least one sensor to enable the system to determine a capacity change of the first tub based in part on a level of blender fluid within the first tub, and the at least one sensor to provide input to the system to enable the overflow fluid to be returned to the first tub.

5. The system of claim 1, further comprising:

at least one sensor to enable the system to determine a capacity change of the first tub based in part on an evacuation of blender fluid from within the first tub to a storage container, and the at least one sensor to provide input to the system to enable the overflow fluid to be returned to the first tub.

6. The system of claim 1, further comprising:

at least one sensor to enable the system to determine a capacity available in the first tub based in part on an evacuation of a first amount of blender fluid from within the first tub, and the at least one sensor to provide input to the system to enable a second amount of the overflow fluid that is less than or equal to the first amount to be returned to the first tub.

7. The system of claim 1, further comprising:

a first height for the second tub, the first height equal to or a lesser than a second height of the first tub.

8. The system of claim 1, further comprising:

at least one first sensor associated with the first tub and at least one second sensor associated with the second tub level, information from the at least one first sensor and the at least one second sensor to enable the system to infer that current level of blender fluid in the first tub and of the overflow fluid in the second tub, and the information to enable the system to retain or return the overflow fluid based in part on a level of the blender fluid.

9. The system of claim 1, further comprising:

at least one sensor associated with one or more of the first tub or the second tub, the at least one sensor comprising one or more of a flow sensor, a flow meter, a radar, or a sonar.

10. The system of claim 1, further comprising:

the second tub adapted to be used to store the overflow fluid for at least a predetermined amount of time irrespective of a level of blender fluid in the first tub.

11. A method comprising:

associating a first tub and a second tub with a fracturing fluid blender;

enabling the second tub to circumvent an outside diameter of the first tub and to comprise a height that is a determined based in part on at least one overflow constraint of an application of the fracturing fluid blender;

buffering or providing blending components for the first tub based in part on the at least one overflow constraint and using a processing unit and tank components; and associating one or more valves and routing pipes with the processing unit and the tank components to direct an overflow fluid received in the second tub, from the first tub, to be returned to the first tub upon a determination that the first tub has a capacity to handle the overflow fluid.

12. The method of claim 11, wherein the on at least one overflow constraint comprises an amount of the overflow fluid expected from a determined mix of the blending components.

13. The method of claim 11, further comprising:

enabling, using at least one sensor, the system to determine a capacity change of the first tub based in part blender fluid discharged from the first tub for a fracturing application; and providing, by the at least one sensor, input to the system to enable the overflow fluid to be returned to the first tub.

14. The method of claim 11, further comprising:

enabling, using at least one sensor, the system to determine a capacity change of the first tub based in part on a level of blender fluid within the first tub; and providing, by the at least one sensor, input to the system to enable the overflow fluid to be returned to the first tub.

15. The method of claim 11, further comprising:

enabling, using at least one sensor, the system to determine a capacity change of the first tub based in part on an evacuation of blender fluid from within the first tub to a storage container; and providing, by the at least one sensor, input to the system to enable the overflow fluid to be returned to the first tub.

16. The method of claim 11, further comprising:

enabling, using at least one sensor, the system to determine a capacity available in the first tub based in part on an evacuation of a first amount of blender fluid from within the first tub; and providing, by the at least one sensor, input to the system to enable a second amount of the overflow fluid that is less than or equal to the first amount to be returned to the first tub.

17. The method of claim 11, further comprising:

enabling a first height for the second tub, the first height equal to or a lesser than a second height of the first tub.

18. The method of claim 11, further comprising:

providing, using at least one first sensor associated with the first tub and using at least one second sensor associated with the second tub level, information from the at least one first sensor and the at least one second sensor for the system;

inferring, by the system, that current level of blender fluid in the first tub and of the overflow fluid in the second tub; and enabling, using the information provided to the system, retention or return of the overflow fluid based in part on a level of the blender fluid.

19. The method of claim 11, further comprising:

associating at least one sensor with one or more of the first tub or the second tub, the at least one sensor comprising one or more of a flow sensor, a flow meter, a radar, or a sonar.

20. The method of claim 11, further comprising:

adapting the second tub to be used to store the overflow fluid for at least a predetermined amount of time irrespective of a level of blender fluid in the first tub.

* * * * *